US010011447B2

(12) United States Patent
Nakamura

(10) Patent No.: US 10,011,447 B2
(45) Date of Patent: Jul. 3, 2018

(54) IMAGE FORMING APPARATUS

(71) Applicant: KONICA MINOLTA, INC., Chiyoda-ku, Tokyo (JP)

(72) Inventor: Masakazu Nakamura, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/270,818

(22) Filed: Sep. 20, 2016

(65) Prior Publication Data

US 2017/0097604 A1 Apr. 6, 2017

(30) Foreign Application Priority Data

Oct. 5, 2015 (JP) ..... 2015-197669

(51) Int. Cl.
*B65H 9/16* (2006.01)
*B65H 7/10* (2006.01)
(Continued)

(52) U.S. Cl.
CPC ..... *B65H 7/10* (2013.01); *B65H 7/02* (2013.01); *B65H 7/20* (2013.01); *B65H 9/106* (2013.01);
(Continued)

(58) Field of Classification Search
CPC ... B65H 7/02; B65H 7/10; B65H 7/20; B65H 9/004; B65H 9/10; B65H 9/103;
(Continued)

(56) References Cited

U.S. PATENT DOCUMENTS 6,019,365 A * 2/2000 Matsumura ..... B65H 7/10 271/227
7,753,370 B2 * 7/2010 Inoue ..... B65H 1/04 271/239
(Continued)

FOREIGN PATENT DOCUMENTS

JP 2008001473 A 1/2008
JP 2013088627 A 5/2013
JP 2015094876 A 5/2015

OTHER PUBLICATIONS

Japanese Office Action (and English translation thereof) dated Nov. 14, 2017, issued in counterpart Japanese Application No. 2015-197669.

*Primary Examiner* — Prasad V Gokhale
(74) *Attorney, Agent, or Firm* — Holtz, Holtz & Volek PC

(57) ABSTRACT

An image forming apparatus includes: a pair of rollers for conveying paper; a rocking mechanism for rocking the pair of rollers in a second direction orthogonal to a first direction, the first direction being a paper conveying direction; an upstream pair of rollers provided upstream of the pair of rollers in the paper conveying direction for conveying the paper; an upstream rocking mechanism corresponding to the upstream pair of rollers for rocking the upstream pair of rollers in the second direction; a first paper detector for detecting an end position of the paper in the second direction; and a controller controlling the rocking mechanism based on the paper end position to effect first rocking correction in which the pair of rollers is rocked, wherein the controller controls the upstream rocking mechanism to effect second rocking correction in which only the upstream pair of rollers is rocked.

6 Claims, 9 Drawing Sheets

(51) Int. Cl.

| | |
|---|---|
| ***G03G 15/00*** | (2006.01) |
| ***B65H 7/20*** | (2006.01) |
| ***B65H 7/02*** | (2006.01) |
| ***B65H 9/10*** | (2006.01) |
| *G03G 15/23* | (2006.01) |

(52) U.S. Cl.
CPC ..... *B65H 9/16* (2013.01); *G03G 15/6567* (2013.01); *G03G 15/6573* (2013.01); *B65H 2404/1422* (2013.01); *B65H 2404/1424* (2013.01); *B65H 2404/1441* (2013.01); *G03G 15/234* (2013.01); *G03G 2215/00405* (2013.01); *G03G 2215/00586* (2013.01); *G03G 2215/0135* (2013.01)

(58) Field of Classification Search
CPC . B65H 9/106; B65H 9/16; B65H 9/20; B65H 2404/142; B65H 2404/1422; B65H 2404/1424; B65H 2404/144; B65H 2404/1441; B65H 2404/1524; G03G 15/6561; G03G 15/6567
See application file for complete search history.

(56) References Cited

U.S. PATENT DOCUMENTS

| | | | | |
|---|---|---|---|---|
| 8,770,581 | B2 * | 7/2014 | Deno | B65H 9/002 271/228 |
| 2005/0206072 | A1 * | 9/2005 | Tanabe | B65H 5/062 271/226 |
| 2007/0284810 | A1 * | 12/2007 | Nakazawa | B65H 9/002 271/228 |
| 2008/0251998 | A1 * | 10/2008 | Muneyasu | B65H 5/34 271/227 |
| 2012/0068398 | A1 * | 3/2012 | Asari | B65H 5/062 271/3.2 |
| 2013/0156478 | A1 * | 6/2013 | Deno | G03G 15/6567 399/395 |
| 2013/0307213 | A1 * | 11/2013 | Adachi | B65H 7/14 271/265.01 |
| 2013/0334769 | A1 * | 12/2013 | Yamazaki | B65H 7/10 271/228 |
| 2015/0132016 | A1 * | 5/2015 | Aoki | G03G 15/6567 399/16 |
| 2016/0023858 | A1 * | 1/2016 | Mizuno | B65H 9/002 271/228 |
| 2016/0272448 | A1 * | 9/2016 | Nakai | B65H 7/10 |

* cited by examiner

IMAGE FORMING APPARATUS

The entire disclosure of Japanese Patent Application No. 2015-197669 filed on Oct. 5, 2015 including description, claims, drawings, and abstract are incorporated herein by reference in its entirety.

BACKGROUND OF THE INVENTION

Field of the Invention

The present invention relates to an image forming apparatus.

Description of the Related Art

Conventionally, image forming apparatuses adopting an electrophotographic system, such as a printer and a copying machine, are widely used. In general image forming apparatuses, there are cases where paper deviates to one side during conveyance in a direction (hereinafter referred to as a paper width direction or a main scanning direction) orthogonal to a conveying direction due to factors including various types and properties of paper to be used, characteristics of components such as conveying rollers, and use environments such as temperature and humidity during the conveyance. Executing a printing process in such conditions problematically reduces printing position accuracy.

Accordingly, so-called registration rocking correction is conventionally made for adjusting the position of the paper in relation to an image. This correction is such that a widthwise deviation amount of the paper is detected by a deviation sensor, and the paper is moved widthwise based on the detection result while being pressed into contact with (held by) a pair of registration rollers. JP 2013-88627 A discloses an image forming apparatus that executes, after registration rocking correction, error processing for improved accuracy of paper deviation correction when a deviation amount of paper that is detected by a deviation sensor is equal to or more than a predetermined amount or determines an adjustment amount for subsequent deviation correction.

The image forming apparatus described in JP 2013-88627 A, however, has the following problem. In cases where the registration rocking correction is made, for example, with a rear end of the paper not passing through a bent portion present in a reversing path where the paper is reversed, sliding friction is caused between the paper and a guide plate due to stiffness of the paper. Recently, there is an increasing demand for feeding of thick paper through a production printer. However, the thick paper has greatly increased stiffness, so that the problem of sliding friction becomes prominent. When paper such as the thick paper is used, a rear end of the paper cannot follow a rocking motion due to increased sliding friction, and consequently, the registration rocking correction results in the paper skewing to a level that cannot be ignored. The image forming apparatus described in JP 2013-88627 A can improve the accuracy of the deviation correction because the deviation correction is performed a plurality of times. However, this apparatus problematically cannot correct the skew of the paper.

SUMMARY OF THE INVENTION

The present invention has been made in view of the problem discussed above, and an object thereof is to provide an image forming apparatus that eliminates a paper skew when a pair of rollers is rocked.

To achieve the abovementioned object, according to an aspect, an image forming apparatus reflecting one aspect of the present invention comprises: a pair of rollers for conveying paper; a rocking mechanism for rocking the pair of rollers in a second direction orthogonal to a first direction with the pair of rollers holding the paper, the first direction being a paper conveying direction; an upstream pair of rollers provided upstream of the pair of rollers in the paper conveying direction for conveying the paper; an upstream rocking mechanism corresponding to the upstream pair of rollers for rocking the upstream pair of rollers in the second direction with the upstream pair of rollers holding the paper; a first paper detector for detecting an end position of the paper in the second direction; and a controller controlling at least the rocking mechanism based on the paper end position detected by the first paper detector to effect first rocking correction in which the pair of rollers is rocked in the second direction, wherein the controller controls after the first rocking correction the upstream rocking mechanism based on a result of end position detection performed by the first paper detector to effect second rocking correction in which only the upstream pair of rollers is rocked in the second direction.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, preferred embodiments of the present invention will be described in detail with reference to the drawings. However, the scope of the invention is not limited to the illustrated examples. It is to be noted that dimension ratios of the drawings are greater for the purpose of explanation and can differ from actual dimension ratios.

First Embodiment

Configuration Example of Image Forming Apparatus 100A

Figure 1:
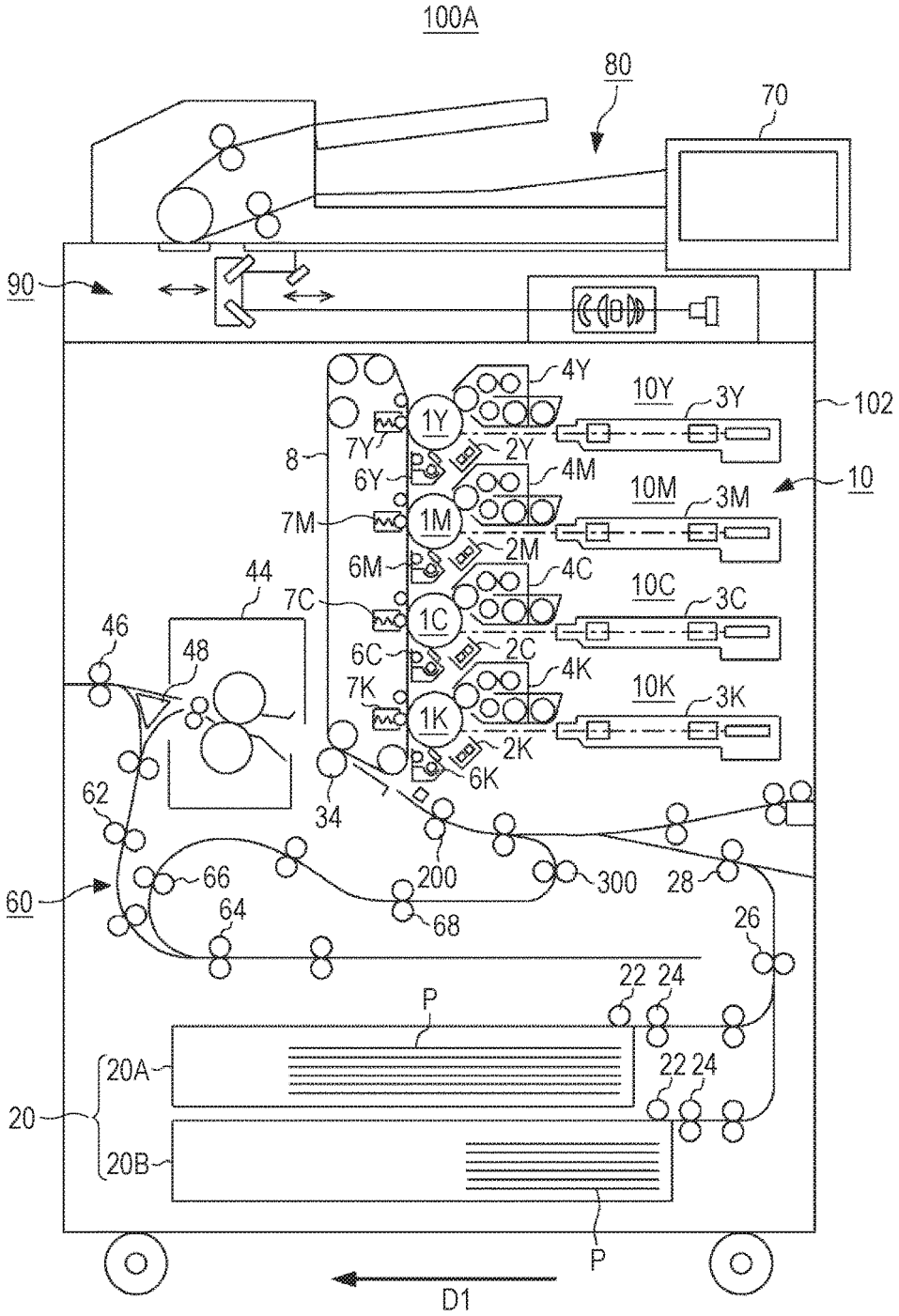
FIG. 1 shows a configuration example of an image forming apparatus according to a first embodiment of the present invention.

FIG. 1 shows the configuration example of the image forming apparatus 100A according to the first embodiment of the present invention. As shown in FIG. 1, the image forming apparatus 100A is called a tandem type image forming apparatus and includes automatic document feeder 80, and an apparatus body 102. The automatic document feeder 80 is mounted above the apparatus body 102 and feeds a document set on a conveyance table to an image reader 90 of the apparatus body 102 by means of, for example, conveying rollers.

The apparatus body 102 includes an operation display 70, the image reader 90, an image forming section 10, an intermediate transfer belt 8, a paper feeder 20, a pair of registration rollers 200, a fixing section 44, and an auto duplex unit (hereinafter referred to as ADU) 60.

The operation display 70 includes a touch panel incorporating a display unit and an input unit, and a plurality of operation keys including a start key and a determination key in the vicinity of the touch panel. This operation display 70 displays an operation menu screen and others and accepts, for example, image forming conditions related to a paper type such as thick paper that are input through touch operation of the operation menu screen or operation of the operation keys.

The image reader 90 performs scanning exposure on a document placed on a document platen or the document fed by the automatic document feeder 80 by means of an optical system of a scanning exposure apparatus and photoelectrically converts an image of the scanned document by means of a CCD (Charge Coupled Device) image sensor to generate an image information signal. The image information signal undergoes, for example, analog processing, analog-to-digital (hereinafter referred to as A/D) conversion, shading correction, and image compression in an image processing section, which is not shown, and is output to the image forming section 10 thereafter.

The image forming section 10 performs electrophotographic image formation and includes an image forming unit 10Y for forming a yellow (Y) image, an image forming unit 10M for forming a magenta (M) image, an image forming unit 10C for forming a cyan (C) image, and an image forming unit 10K for forming a black (K) image. In this embodiment, reference marks having a common function name, such as reference marks 10, are trailed by respective color indications Y, M, C, K.

The image forming unit 10Y includes a photoreceptor drum 1Y, a charger 2Y disposed in the vicinity of the photoreceptor drum 1Y, an exposure unit (optical writing unit) 3Y, a developing device 4Y, and a cleaning unit 6Y. The image forming unit 10M includes a photoreceptor drum 1M, a charger 2M disposed in the vicinity of the photoreceptor drum 1M, an exposure unit 3M, a developing device 4M, and a cleaning unit 6M. The image forming unit 10C includes a photoreceptor drum 1C, a charger 2C disposed in the vicinity of the photoreceptor drum 1C, an exposure unit 3C, a developing device 4C, and a cleaning unit 6C. The image forming unit 10K includes a photoreceptor drum 1K, a charger 2K disposed in the vicinity of the photoreceptor drum 1K, an exposure unit 3K, a developing device 4K, and a cleaning unit 6K.

The respective photoreceptor drums 1Y, 1M, 1C, 1K of the image forming units 10Y, 10M, 10C, 10K structurally have commonalities, and the same goes for the respective chargers 2Y, 2M, 2C, 2K, the respective exposure units 3Y, 3M, 3C, 3K, the respective developing devices 4Y, 4M, 4C, 4K, the respective cleaning units 6Y, 6M, 6C, 6K, and respective primary transfer rollers 7Y, 7M, 7C, 7K of the image forming units 10Y, 10M, 10C, 10K. Except for cases where distinction is specifically required, those color indications Y, M, C, K are omitted hereinafter.

The chargers 2 electrify respective surfaces of the photoreceptor drums 1 uniformly. The exposure units 3 are each formed of, for example, an LPH (LED Print Head) having an LED array and imaging lenses or a laser exposure scanning apparatus using a polygon mirror. Based on the image information signal, the exposure units 3 each form an electrostatic latent image on the photoreceptor drum 1 by means of a laser beam scan. The developing devices 4 each develop the electrostatic latent image formed on the photoreceptor drum 1 by using toner, thus forming a visible toner image on the photoreceptor drum 1.

The intermediate transfer belt 8 is stretched and rotatably supported by a plurality of rollers. As the intermediate transfer belt 8 rotates, the primary transfer rollers 7 and the photoreceptor drums 1 rotate, and application of a predetermined voltage between each of the primary transfer rollers 7 and the corresponding photoreceptor drum 1 causes the toner image formed on the photoreceptor drum 1 to be transferred to the intermediate transfer belt 8 (primary transfer).

The paper feeder 20 includes a plurality of paper feed trays 20A, 20B each accommodating paper P such as A3-sized paper or A4-sized paper. The paper P conveyed from the paper feed tray 20A or 20B by conveying rollers 22, 24, 26, 28, for example, is conveyed to the pair of registration rollers 200. It is to be noted that the number of the paper feed trays is not limited to two. Moreover, one or more large-capacity paper feeders accommodating the paper P in quantity may be connected on an as needed basis.

The pair of registration rollers 200 corrects a skew of the paper P by causing a leading end of the paper P conveyed from the paper feeder 20 or the like to abut for formation of a loop and corrects deviation of paper P to one side by rocking the paper P in a paper width direction D2 while holding the paper P. The paper P having its deviation or the other corrected is conveyed to a secondary transfer section. 34 in predetermined timing.

In the secondary transfer section 34, the Y-colored, M-colored, C-colored and K-colored toner images transferred to the intermediate transfer belt 8 are collectively transferred to a surface of the paper P conveyed by the pair of registration rollers 32 (secondary transfer). Having undergone the secondary transfer, the paper P is conveyed to the fixing section 44 disposed at a downstream side of a paper conveying direction D1. The fixing section 44 includes a pressure roller, and a heating roller. This fixing section 44 applies pressure and heat to the paper P having the toner images transferred in the secondary transfer section 34, thereby fixing the toner images on the surface of the paper P.

A conveying path switching section 48 switches a conveying path for the paper P over to a paper ejection path or the ADU 60 based on a selected print mode (such as a simplex print mode or a duplex print mode). Having undergone simplex printing in the simplex print mode or duplex printing in the duplex print mode, the paper P is ejected onto a paper output tray by paper delivery rollers 46.

To be formed with an image on its back side in the duplex print mode, the paper P formed with the image on its front side is conveyed to the ADU 60 by, for example, conveying rollers 62. In a switchback path of the ADU 60, the paper P is conveyed to a U-turn path with its rear end being in the lead through reverse rotation control of ADU rollers 64 and is fed again in a reversed state to the secondary transfer section 34 by, for example, conveying rollers 66, 68, 300 provided in the U-turn path.

It is to be noted that the above-mentioned image forming apparatus 100A of FIG. 1 may form an image forming system by having a post-processing device having functions including punching, folding, side stitching, and stapling coupled at a downstream side of the paper conveying direction D1.

Configuration Example of Pair of Registration Rollers 200 and Others

Figure 2:
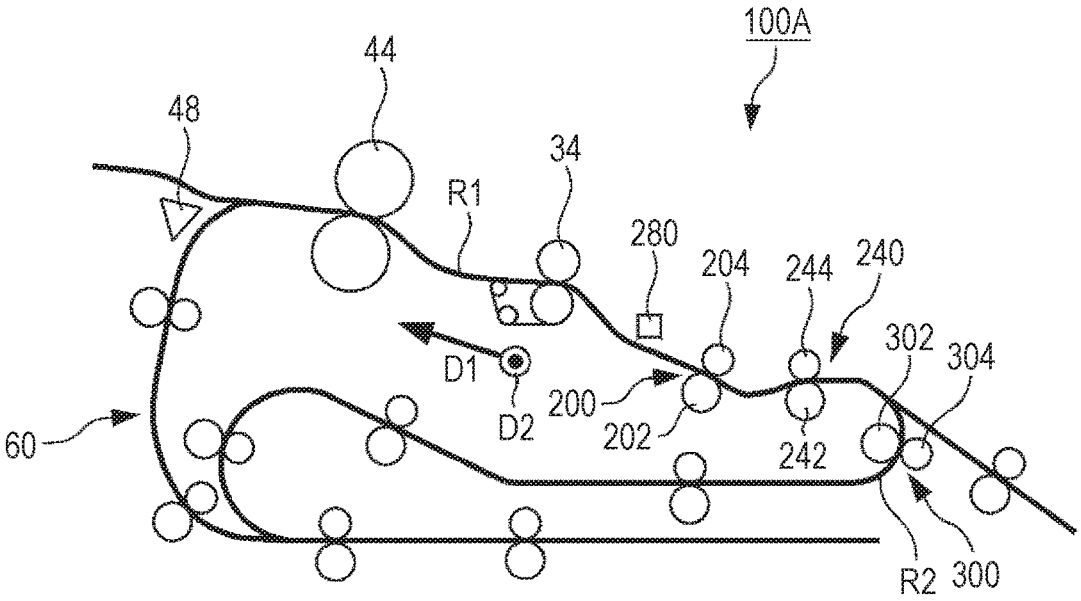
FIG. 2 shows a configuration example of a pair of registration rollers, a pair of loop rollers, and ADU conveying rollers.

FIG. 2 shows the configuration example of the pair of registration rollers 200, a pair of loop rollers 240, and the pair of ADU conveying rollers 300. The pair of registration rollers 200 and the pair of loop rollers 240 or the like form a registration section for performing, for example, correction of the paper skew.

As shown in FIG. 2, the pair of registration rollers 200 is disposed upstream of the secondary transfer section 34 in a conveying path R1 along the paper conveying direction D1. The pair of registration rollers 200 is formed of a driving roller 202 for rotative driving, and a driven roller 204 that rotates, driven by the rotation of the driving roller 202. This pair of registration rollers 200 corrects the skew of the paper P through the loop formation effected by the abutment of the leading end of the paper P, corrects alignment between the leading end of the paper P and a leading end of the image when the paper P is conveyed again and corrects the deviation of the paper P to the side by rocking the paper P in the paper width direction D2 while holding the paper P.

The pair of loop rollers 240 is disposed upstream of the pair of registration rollers 200 in the conveying path R1 along the paper conveying direction D1. The pair of loop rollers 240 is formed of a driving roller 242 for rotative driving, and a driven roller 244 that rotates, driven by the rotation of the driving roller 242. This pair of loop rollers 240 causes the loop to be formed by bringing the leading end of the paper P into abutment against a nip portion of the pair of registration rollers 200 through adjustment of a feed rate of the paper P.

A deviation detecting sensor 280 is disposed downstream of the pair of registration rollers 200 in the paper conveying direction D1. The deviation detecting sensor 280 can be formed of a line sensor having a plurality of photoelectric conversion elements arranged linearly along the paper width direction D2 or an image sensor having photoelectric conversion elements arranged in a matrix-like pattern. CCD image sensors can be used as the line sensor, while CMOS image sensors (including MOS image sensors) can be used as the image sensor.

The pair of ADU conveying rollers 300 is disposed in a substantially U-shaped bent path R2 of the ADU 60. The bent path R2 is formed of, for example, a pair of guide plates disposed to face each other. The pair of ADU conveying rollers 300 is formed of a driving roller 302 for rotative driving, and a driven roller 304 that rotates, driven by the rotation of the driving roller 302. This pair of ADU conveying rollers 300 feeds the paper P to the registration section again with the paper P being reversed.

Figure 3:
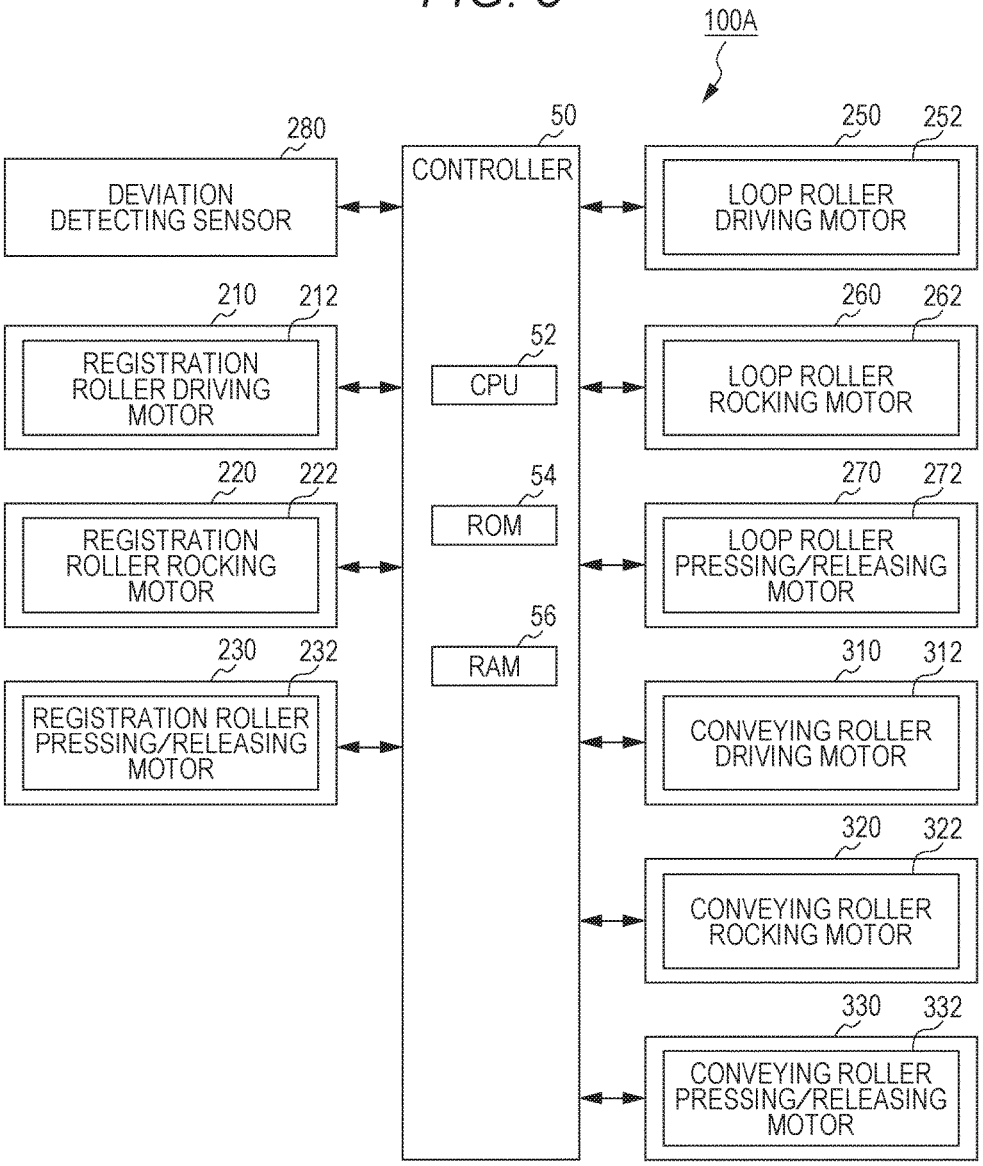
FIG. 3 is a block diagram showing a functional configuration example of the image forming apparatus.

Configuration Example of Image Forming Apparatus 100A in Block Diagram Form FIG. 3 is the block diagram showing the functional configuration example of the image forming apparatus 100A. As shown in FIG. 3, the image forming apparatus 100A includes a controller 50, a registration roller conveyance mechanism 210, a registration roller rocking mechanism 220, a registration roller pressing/releasing mechanism 230, the deviation detecting sensor 280, a loop roller conveyance mechanism 250, a loop roller rocking mechanism 260, a loop roller pressing/releasing mechanism 270, a conveying roller conveyance mechanism 310, a conveying roller rocking mechanism 320, and a conveying roller pressing/releasing mechanism 330. The controller 50 is connected to these components including the registration roller conveyance mechanism 210.

The controller 50 includes a CPU (Central Processing Unit) 32, a ROM (Read Only Memory) 54, and a RAM (Random Access Memory) 56. The CPU 52 controls each of the above-mentioned components including the registration roller conveyance mechanism 210 by executing software (a program) read from the ROM 54, thereby implementing a function related to image formation, such as operation for rocking or pressing and releasing, for example, the pair of registration rollers 200.

The registration roller conveyance mechanism 210 is a mechanism for conveying the paper P in the paper conveying direction D1 by rotatively driving the pair of registration rollers 200. This registration roller conveyance mechanism 210 includes a registration roller driving motor 212. The registration roller driving motor 212 is driven based on a drive signal supplied from the controller 50 to effect positive rotation or reverse rotation of the pair of registration rollers 200.

The registration roller rocking mechanism 220 is a mechanism for rocking the pair of registration rollers 200 in the paper width direction D2. This registration roller rocking mechanism 220 includes a registration roller rocking motor 222, and those that are not shown in the drawing, such as a rack and a pinion gear. The registration roller rocking motor 222 is driven based on a drive signal supplied from the controller 50 to rock the pair of registration rollers 200 in the paper width direction D2.

The registration roller pressing/releasing mechanism 230 is a mechanism for pressing the driven roller 204 against the driving roller 202 and separating the driven roller 204 from the driving roller 202. This registration roller pressing/releasing mechanism 230 includes a registration roller pressing/releasing motor 232 and those that are not shown in the drawing, such as a cam and a cam follower. The registration roller pressing/releasing motor 232 is driven based on a drive signal supplied from the controller 50 to press one of the pair of registration rollers 200 against the other and separate the pair of registration rollers 200.

The loop roller conveyance mechanism 250 is a mechanism for conveying the paper P in the paper conveying direction D1 by rotatively driving the pair of loop rollers 240. This loop roller conveyance mechanism 250 includes a loop roller driving motor 252. The loop roller driving motor 252 is driven based on a drive signal supplied from the controller 50 to rotate the pair of loop rollers 240.

The loop roller rocking mechanism 260 is a mechanism for rocking the pair of loop rollers 240 in the paper width direction D2. This loop roller rocking mechanism 260 includes a loop roller rocking motor 262 and those that are not in the drawing, such as a rack and a pinion gear. The loop roller rocking motor 262 is driven based on a drive signal supplied from the controller 50 to rock the pair of loop rollers 240 in the paper width direction D2.

The loop roller pressing/releasing mechanism 270 is a mechanism, for pressing the driven roller 244 against the driving roller 242 and separating the driven roller 244 from the driving roller 242. This loop roller pressing/releasing mechanism 270 includes a loop roller pressing/releasing motor 272 and those that are not shown in the drawing, such as a cam and a cam follower. The loop roller pressing/releasing motor 272 is driven based on a drive signal supplied from the controller 50 to press one of the pair of loop rollers 240 against the other and separate the pair of loop rollers 240.

The conveying roller conveyance mechanism 310 is a mechanism for conveying the paper P in the paper conveying direction D1 by rotatively driving the pair of ADU conveying rollers 300. This conveying roller conveyance mechanism 310 includes a conveying roller driving motor 312. The conveying roller driving motor 312 is driven based on a drive signal supplied from the controller 50 to rotate the pair of ADU conveying rollers 300.

The conveying roller rocking mechanism 320 is a mechanism, for rocking the pair of ADU conveying rollers 300 in the paper width direction D2. This conveying roller rocking mechanism 320 includes a conveying roller rocking motor 322 and those that are not shown in the drawing, such as a rack and a pinion gear. The conveying roller rocking motor 322 is driven based on a drive signal supplied from the controller 50 to rock the pair of ADU conveying rollers 300 in the paper width direction D2.

The conveying roller pressing/releasing mechanism 330 is a mechanism for pressing the driven roller 304 against the driving roller 302 and separating the driven roller 304 from the driving roller 302. This conveying roller pressing/releasing mechanism 330 includes a conveying roller pressing/releasing motor 332 and those that are not shown in the drawing, such as a cam and a cam follower. The conveying roller pressing/releasing motor 332 is driven based on a drive signal supplied from the controller 50 to press one of the pair of ADU conveying rollers 300 against the other and separate the pair of ADU conveying rollers 300.

Example of Operation of Image Forming Apparatus 100A

Figure 4:
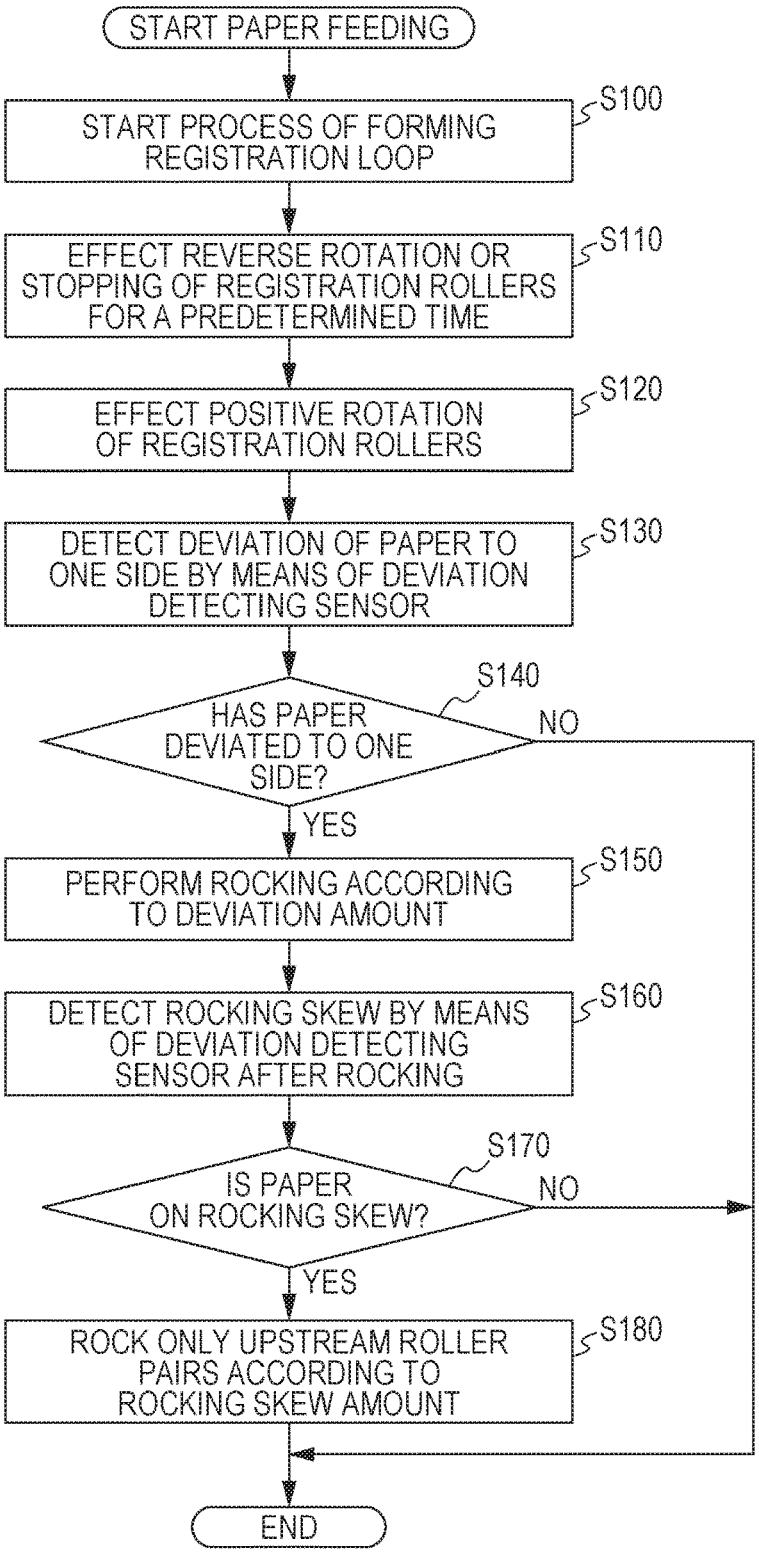
FIG. 4 is a flowchart showing an example of operation of the image forming apparatus during image formation.

FIG. 4 is a flowchart showing the example of operation of the image forming apparatus 100A during image formation. FIGS. 5A to 5C and FIGS. 6A to 6C illustrate operation of the pair of registration rollers 200 and others during registration rocking correction. The controller 50 (CPU 52) of the image forming apparatus 100A executes the software read from the ROM 54, thereby implementing processing shown by the flowchart of FIG. 4. It is to be noted that the following description refers to a duplex print job.

Figure 5A:
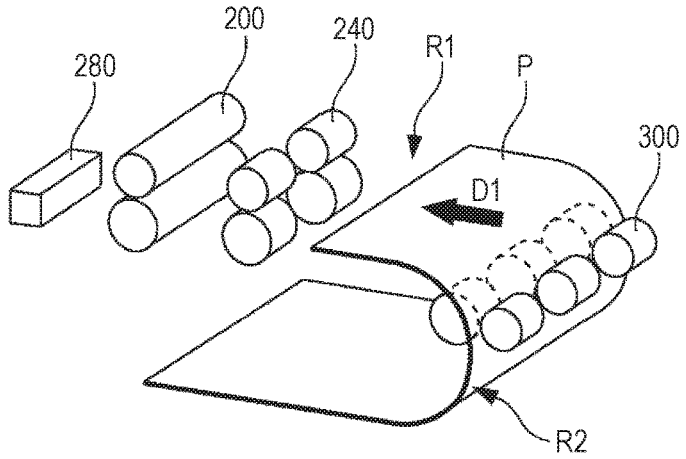
FIGS. 5A to 5C illustrate a first part of registration rocking correction.

After completion of printing on the front side of the paper P in the secondary transfer section 34, the fixing section 44 performs fixing, and the paper P is conveyed to the ADU 60 thereafter. The controller 50 drives the conveying roller driving motor 312, thereby rotating the pair of ADU conveying rollers 300. Accordingly, as shown in FIG. 5A, the paper P is conveyed from the bent path R2 of the ADU 60 toward the pair of loop rollers 240 disposed in the conveying path R1.

Figure 5B:
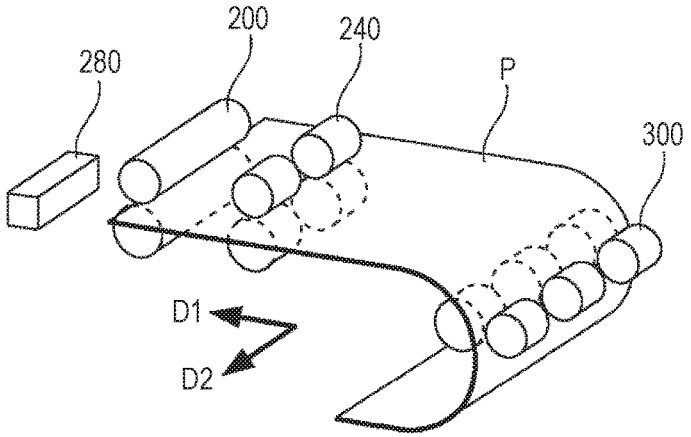
Figure 5C:
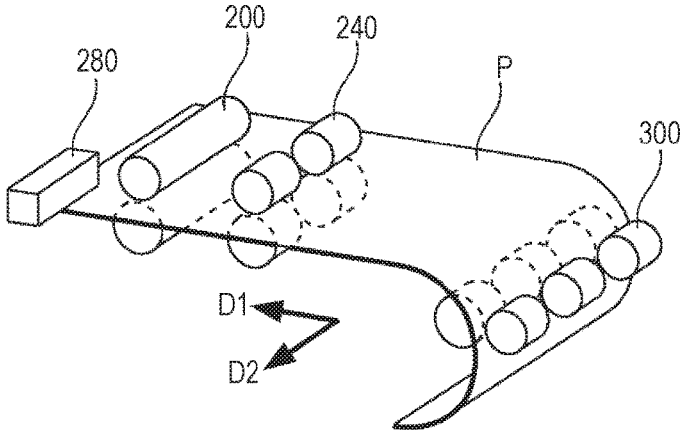

As shown in FIG. 4, the controller 30 starts a process of forming a registration loop in step S100. For example, the controller 50 drives the loop roller driving motor 252, thereby rotating the pair of loop rollers 240. Accordingly, the paper P is conveyed toward the pair of registration rollers 200, and as shown in FIG. 5B, the leading end of the paper P reaches the nip portion of the pair of registration rollers 200.

In step S110, the controller 50 controls the driving of the registration roller driving motor 212 to effect the reverse rotation or stopping of the pair of registration rollers 200 for a predetermined time. Accordingly, the paper P curls up to form a predetermined amount of loop, which is not shown, thus having its skew corrected.

In step S120, the controller 50 controls the driving of the registration roller driving motor 212 to effect the positive rotation of the pair of registration rollers 200. Accordingly, the conveyance of the paper P is resumed, and the paper P is conveyed toward the secondary transfer section 34.

In step S130, the deviation detecting sensor 280 detects, as shown in FIG. 50, an end position of the paper P in the paper width direction D2 as the paper P passes through. In the present embodiment, a deviation amount of the paper P is defined based on a difference between the end position of the paper P that is detected by the deviation detecting sensor 280 and a preset reference end position (design position)

In step S140, the controller 50 determines whether the paper P has deviated to one side based on the deviation amount of the paper P that is detected by the deviation detecting sensor 280. The controller 50 determines whether the paper P has deviated to the side based on, for example, a determination as to whether the deviation amount of the paper P exceeds a preset threshold amount (whether the end position of the paper P is the reference end position). When the controller 50 determines that the paper P has not deviated to the side, the paper P is conveyed to the secondary transfer section 34 with rocking correction (hereinafter referred to as first rocking correction) not performed by the pair of registration rollers 200 because the paper P passes through as intended.

Figure 6A:
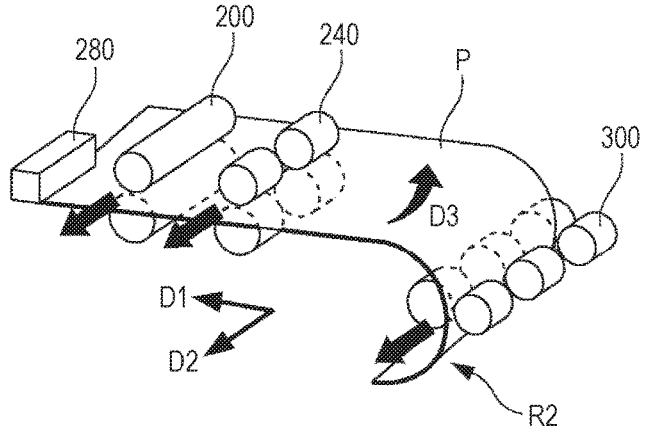
FIGS. 6A to 6C illustrate a second part of the registration rocking correction.
Figure 6B:
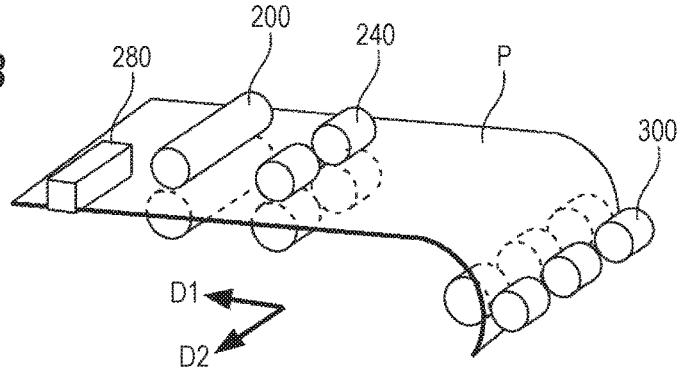

On the other hand, when the controller 50 determines in step S140 that the paper P has deviated to the side, the processing proceeds to step S150. It is to be noted that in the present embodiment, the paper P deviates from the reference end position to a back side (of a paper surface of, for example, FIGS. 6A to 6C) in the paper width direction D2. In step S150, the controller 50 effects the first rocking correction by means of the pair of registration rollers 200 according to the obtained deviation amount of the paper P. Specifically, the controller 50 generates rocking command values based on the deviation amount of the paper P and supplies the rocking command values to the registration roller rocking motor 222, the loop roller rocking motor 262, and the conveying roller rocking motor 322, respectively. Accordingly, as shown in FIG. 6A. The pair of registration rollers 200, the pair of loop rollers 240, and the pair of ADU conveying rollers 300 rock the paper P toward a front side in the paper width direction D2 while holding the paper P.

Here, sliding friction is caused between the paper P and the guide plate in the bent path R2 of the ADU 60, so that the rear end of the paper P is rocked by a reduced amount as compared to the leading end of the paper P. Consequently, the paper P can be on the rocking skew in a direction of arrow D3. The rocking skew of the paper P occurs prominently especially when the thick paper is used as the paper P. For this reason, in the present embodiment, additional registration rocking correction (hereinafter referred to as second rocking correction) is performed for correcting the skew of the paper P after the first rocking correction of step S150.

In step S160, after the first rocking correction, the deviation detecting sensor 280 detects an end position of the paper P in the paper width direction D2 (a skew amount of the paper P that results from the first rocking correction) during conveyance. In the present embodiment, the deviation detecting sensor 280 performs a plurality of paper end position detections in the paper width direction D2 during conveyance. The detection of the plurality of end positions of the paper P ensures accurate detection of the skew amount of the paper P that results from the first rocking correction.

It is to be noted that before the process of step S160 is carried out, it may be determined whether the paper P used is the thick paper, and when the paper P is the thick paper, the deviation detecting sensor 280 may perform the additional end position detection on the paper P. This is because when the paper P is not the thick paper, the paper P is hard to skew in the first rocking correction. The determination as to whether the paper P is the thick paper can be made based on, for example, information about the type of the paper P that is input by a user by means of the operation display 70 or paper information (the image forming conditions) included in a job transmitted from an information, terminal such as a computer.

In step S170, the controller 50 determines whether the paper P is on the rocking skew based on the rocking skew amount of the paper P that is detected by the deviation detecting sensor 280. The controller 50 determines whether the paper P is on the rocking skew based on, for example, a result of comparison between the rocking skew amount that is calculated from a paper angle (inclination) based on the plurality of end positions of the paper P, conveyance speed, and others, and a preset reference rocking skew amount.

When the controller 50 determines after the first rocking correction that the paper P is not on the rocking skew, the paper P is conveyed to the secondary transfer section 34 with the second rocking correction not performed by way of addition. In a case where, for example, paper having a normal thickness is used as the paper P, such paper has reduced stiffness and thus has reduced sliding friction with respect to the guide plate, so that it is hard for the paper P to be on the rocking skew. Accordingly, in the case of this paper condition, the second rocking correction is not performed.

Figure 6C:
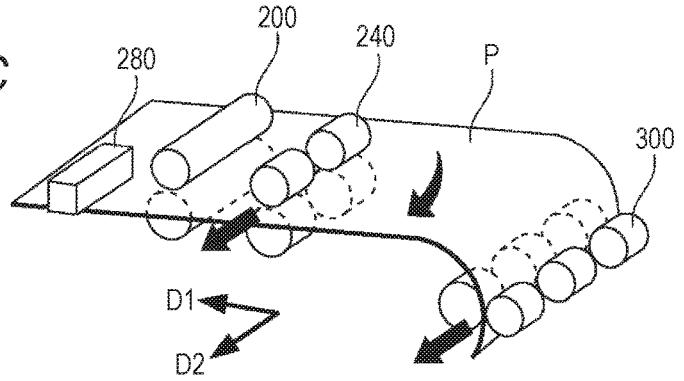

On the other hand, when the controller 50 determines in step S170 that the paper P is on the rocking skew, the processing proceeds to step S180. In step S180, the controller 50 effects the second rocking correction by way of addition by means of the pair of registration rollers 200 according to the obtained rocking skew amount of the paper P. Specifically, the controller 50 generates rocking command values based on the rocking skew amount of the paper P and supplies the rocking command values to the loop roller rocking motor 262 and the conveying roller rocking motor 322, respectively. Accordingly, as shown in FIG. 6C, only the pair of loop rollers 240 and the pair of ADU conveying rollers 300 rock toward the front side in the paper width direction D2 while the paper P is held by the pair of registration rollers 200, the pair of loop rollers 240, and the pair of ADU conveying rollers 300. Consequently, the paper P rotates on the pair of registration rollers 200, thus having its rocking skew corrected.

It is to be noted that when effecting the second rocking correction, the controller 50 may control the registration roller pressing/releasing motor 232 so that the pair of registration rollers 200 has a reduced nip pressure compared with, for example, its normal nip pressure during the first rocking correction. Thus, the paper P held by the pair of registration rollers 200 can be rocked (rotated) smoothly by the pair of loop rollers 240 and the pair of ADU conveying rollers 300.

It is also to be noted that when effecting the second rocking correction, the controller 50 may control the registration roller pressing/releasing motor 232 so that the pair of registration rollers 200 has a reduced nip pressure on one side as compared with its nip pressure on the other side. In this case, the nip pressure of the pair of registration rollers 200 is preferably higher on the side close to the deviation detecting sensor 280. A portion where the nip pressure of the pair of registration rollers 200 is higher thus serves as a fulcrum of rotation when the pair of loop rollers 240 and the pair of ADU conveying rollers 300 are rocked, whereby the skew of the paper P can be effectively corrected.

As described above, when the rocking skew of the paper P results from the first rocking correction, the second rocking correction is performed by way of addition in the first embodiment, so that the skew of the paper P that results from the first rocking correction can be eliminated without fail. Thus, needs for designing a longer straight path including the pair of registration rollers 200 and the pair of loop rollers 240 in the conveying path R1 and designing a largely bent path R2 are eliminated. Consequently, the image forming apparatus 100A can be prevented from being increased in size. Even in cases where the first rocking correction is performed at the time when the rear end of the paper P is in the bent path R2 of the ADU 60 in duplex printing, the second rocking correction is performed, thereby correcting the skew of the paper P. Elimination of the skew of the paper P without fail especially when the paper P is thick or large-sized is a remarkable effect obtained.

Figure 7A:
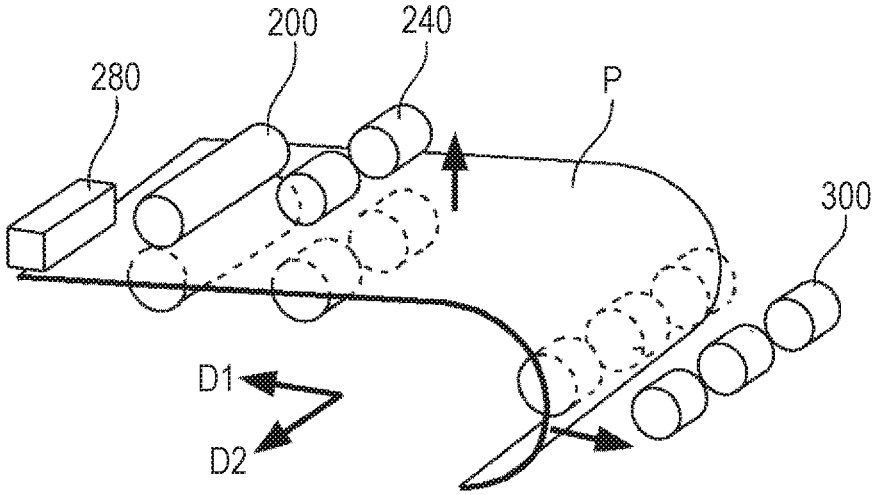
FIGS. 7A and 7B illustrate registration rocking correction in accordance with a modification according to the first embodiment of the present invention.
Figure 7B:
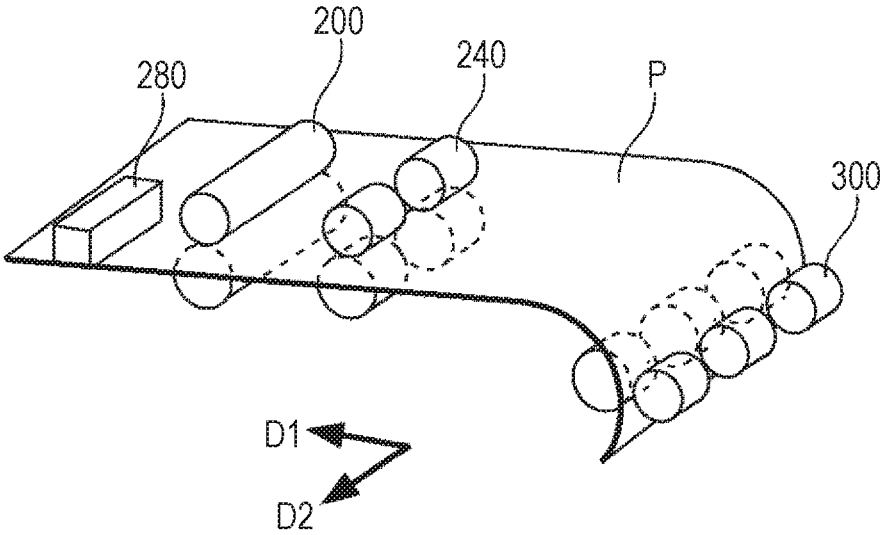

In the first embodiment, the pair of loop rollers 240 and the pair of ADU conveying rollers 300 are rocked while holding the paper P in the first rocking correction; however, the present invention is not limited to this. FIGS. 7A and 7B illustrate a modification of the first rocking correction of the first embodiment.

As shown in FIG. 7A, in the first rocking correction intended for correcting the paper deviation to the side, a nip using the upstream pair of loop rollers 240 and a nip using the upstream pair of ADU conveying rollers 300 are cancelled, and with only the pair of registration rollers 200 pressed against each other, the paper P is rocked in the paper width direction D2. After completion of the first rocking correction, as shown in FIG. 7B, the upstream pair of loop rollers 240 and the upstream pair of ADU conveying rollers 300 are each pressed against each other, and the deviation detecting sensor 280 detects the rocking skew amount of the paper P thereafter. In the present invention, even such first rocking correction can correct the deviation of the paper P to the side.

Second Embodiment

An image forming apparatus 100B according to the second embodiment differs from that of the first embodiment in that a rocking skew of paper P that results from registration rocking correction is corrected through use of two deviation detecting sensors. A deviation detecting sensor 280 described in the first embodiment is hereinafter referred to as a first deviation detecting sensor 280. Except for the above, the image forming apparatus 100B is similar in structure and operation to the image forming apparatus 100A of the first embodiment, so that common components have the same reference marks, and a detailed description of those components are omitted.

Configuration Example of Image Forming Apparatus 100B

Figure 8:
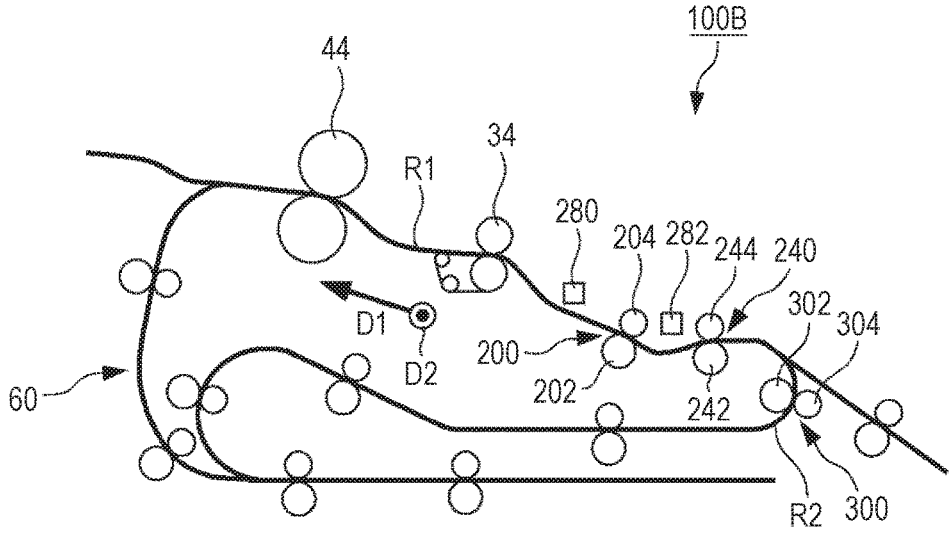
FIG. 8 shows a configuration example of a first deviation detecting sensor and a second deviation detecting sensor according to a second embodiment of the present invention.

FIG. 8 schematically shows the configuration example of the image forming apparatus 100B according to the second embodiment of the present invention. As shown in FIG. 8, the image forming apparatus 100B has a second deviation detecting sensor 282 in addition to the structure of the image forming apparatus 100A of the first embodiment.

The second deviation detecting sensor 282 is disposed upstream of a pair of registration rollers 200 in a conveying path R1 along a paper conveying direction D1. Specifically, the second deviation detecting sensor 282 is disposed between the pair of registration rollers 200 and a pair of loop rollers 240. Similarly to the first deviation detecting sensor 280, this second deviation detecting sensor 282 can be formed of a line sensor having a plurality of photoelectric conversion elements arranged linearly along a paper width direction D2 or an image sensor having photoelectric conversion elements arranged in a matrix-like pattern. The second deviation detecting sensor 282 detects an end position of the paper P with respect to a reference end position in the paper width direction D2. In the present embodiment, an end position detected by the first deviation detecting sensor 280 is referred to as a first end position, while the end position detected by the second deviation detecting sensor 282 is referred to as a second end position.

Example of Operation of Image Forming Apparatus 100B

Figure 9A:
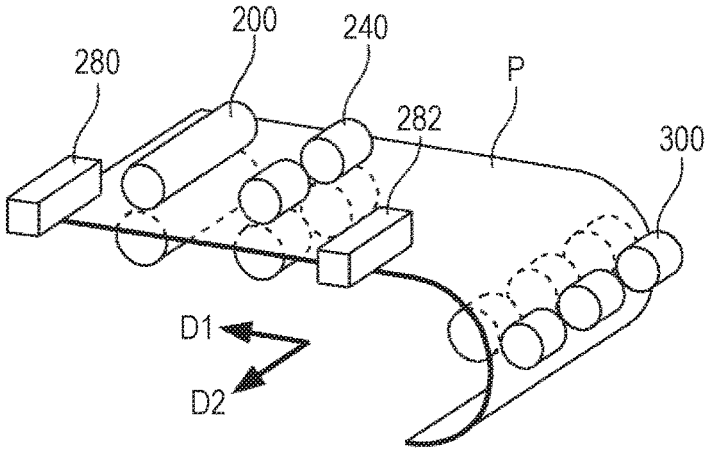
FIGS. 9A to 9C illustrate registration rocking correction.
Figure 9B:
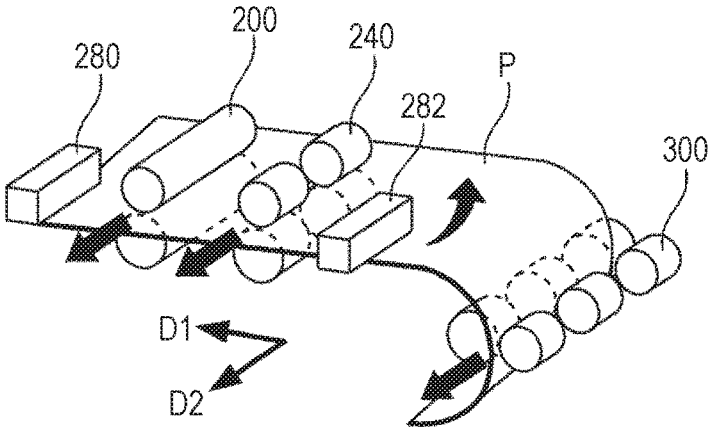
Figure 9C:
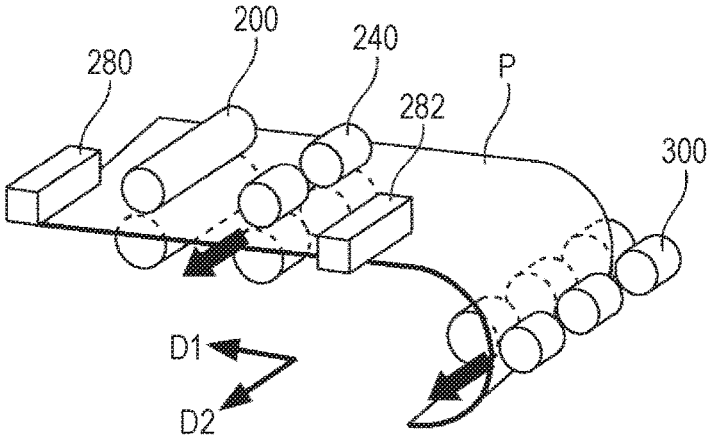

FIGS. 9A to 9C illustrate registration rocking operation according to the second embodiment of the present invention. The second embodiment has respective processes of steps S100 to S150 in the flowchart of FIG. 4 in common with the first embodiment, and only respective processes of steps S160 to S180 in the present embodiment are different from those of the first embodiment. Thus, a detailed description is provided hereinafter of the steps S160 to S180 with reference to FIG. 4 and FIGS. 9A to 9C.

In the steps S100 to S150, a paper skew is corrected in a process of forming a registration loop, and thereafter, when it is determined from a result of detection by the first deviation detecting sensor 280 that the paper P has deviated to one side, the deviation of the paper P to the side is corrected by first rocking correction (FIGS. 9A and 9B). After completion of the deviation correction, processing proceeds to step S160.

In the step S160, the first deviation detecting sensor 280 detects the first end position of the paper P in the paper width direction D2, while the second deviation detecting sensor 282 detects the second end position of the paper P in the paper width direction D2.

In the step S170, as to whether the rocking skew of the paper P has resulted from the first rocking correction, a controller 50 determines from a differential value between the first end position of the paper P that is detected by the first deviation detecting sensor 280 and the second end position of the paper P that is detected by the second deviation detecting sensor 282. The controller 50 determines based on, for example, whether the differential value between the first and second end positions exceeds a preset permissible value. It is to be noted that the greater the differential value, the greater the rocking skew of the paper P.

When the controller 50 determines that the paper P is not on the rocking skew, the paper P is conveyed to a secondary transfer section 31 with second rocking correction not performed by way of addition. In a case where, for example, paper having a normal thickness is used as the paper P, such paper has reduced stiffness and thus has reduced sliding friction with respect to the guide plate, so that it is hard for the paper P to be on the rocking skew. Accordingly, in the case of this paper condition, the second rocking correction is not performed.

On the other hand, when the controller 50 determines in step S170 that the paper P is on the rocking skew, the processing proceeds to step S180. In step S180, the controller 50 effects the second rocking correction by way of addition by means of the pair of registration rollers 200 based on the obtained first and second end positions of the paper P. Specifically, the controller 50 drives the loop roller rocking motor 262 and a conveying roller rocking motor 322, thereby rocking only the pair of loop rollers 240 and a pair of ADU conveying rollers 300 toward a front side in the paper width direction D2 as shown in FIG. 90 with the paper P being held by the pair of registration rollers 200, the pair of loop rollers 240, and the pair of ADU conveying rollers 300. In the present embodiment, such a process is carried out until no differential value between the first and second end positions is obtained. In cases where the second end position has a larger amount of deviation, the second rocking correction is performed so as to bring the second end position into alignment with the first end position. In cases where the first end position has deviated, the second rocking correction is performed with the deviation of the first end position also taken into consideration.

As described above, according to the second embodiment, a functional effect similar to that of the first embodiment can be obtained. Specifically, the rocking skew of the paper P results from the first rocking correction, the second rocking correction is performed by way of addition, so that the skew of the paper P that results from the first rocking correction can be eliminated without fail. Moreover, the second rocking correction is performed through use of the two sensors, that is to say, the first deviation detecting sensor 280 and the second deviation detecting sensor 282, so that the skew of the paper P can be corrected with high accuracy.

It is to be noted that the technical scope of the present invention is not limited by the embodiments and includes various modifications to the embodiments without departing from the spirit t of the present invention. For example, although the image forming apparatus 100A shown in FIG. 1 forms color images, the present invention is not limited to the image forming apparatus that forms the color images and is also applicable to an image forming apparatus that forms monochrome images.

In the embodiments, the leading end of the paper P is aligned by the pair of registration rollers 200 for correction; however, the present invention is not limited to this. The skew of the paper P may be corrected by, for example, a publicly known technique such as a side guide plate or a shutter member that is provided upstream of the pair of registration rollers 200 in the paper conveying direction D1 while the pair of registration rollers 200 is used as conveying rollers.

In the embodiments, the second rocking correction is performed as the registration rocking correction on the paper P present in the bent path R2 in duplex printing; however, the present invention is not limited to this. The second rocking correction may be performed, for example, even when the paper P is in the conveying path R1 (straight path) in simplex printing because the paper P is possibly on the rocking skew when the thick paper, for example, is used.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a pair of rollers which convey paper;

a rocking mechanism which rocks the pair of rollers in a second direction orthogonal to a first direction with the pair of rollers holding the paper, the first direction being a paper conveying direction;

an upstream pair of rollers which convey the paper and are provided upstream of the pair of rollers in the paper conveying direction;

an upstream rocking mechanism which corresponds to the upstream pair of rollers and which rocks the upstream pair of rollers in the second direction with the upstream pair of rollers holding the paper;

a first paper detector which detects an end position of the paper in the second direction; and a controller which controls at least the rocking mechanism based on the paper end position detected by the first paper detector to effect a first rocking correction in which the pair of rollers is rocked in the second direction, wherein the controller controls, after the first rocking correction, the upstream rocking mechanism based on a result of end position detection performed by the first paper detector to effect a second rocking correction in which only the upstream pair of rollers is rocked in the second direction, the upstream pair of rollers holding the paper while being rocked.

2. The image forming apparatus according to claim 1, further comprising a roller pressure adjusting mechanism, wherein the controller controls the roller pressure adjusting mechanism to reduce nip pressure of the pair of rollers when effecting the second rocking correction.

3. The image forming apparatus according to claim 1, further comprising a roller pressure adjusting mechanism, wherein when effecting the second rocking correction, the controller controls the roller pressure adjusting mechanism so that the pair of rollers has a reduced nip pressure on one side in the second direction as compared with a nip pressure thereof on another side.

4. The image forming apparatus according to claim 1, further comprising a second paper detector provided upstream of the pair of rollers in the paper conveying direction, which detects an end position of the paper in the second direction when the second rocking correction is performed.

5. The image forming apparatus according to claim 1, wherein the controller determines whether to effect the second rocking correction based on a type of the paper.

6. The image forming apparatus according to claim 1, wherein the pair of rollers is a pair of registration rollers which cause a leading end of the paper to abut against a nip portion thereof for correction of a skew of the paper.

* * * * *